US006973813B2

(12) United States Patent
Erdely

(10) Patent No.: US 6,973,813 B2
(45) Date of Patent: Dec. 13, 2005

(54) RE-KEYABLE LOCK AND METHOD

(75) Inventor: Edward Erdely, Aliso Viejo, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/729,555

(22) Filed: Dec. 5, 2003

(65) Prior Publication Data

US 2005/0120765 A1 Jun. 9, 2005

(51) Int. Cl.[7] ..... E05B 27/00

(52) U.S. Cl. ..... 70/492; 70/495; 70/377; 70/384; 70/419

(58) Field of Search ..... 70/419, 492, 340, 70/377, 495, 382, 384

(56) References Cited

U.S. PATENT DOCUMENTS

| | | | | |
|---|---|---|---|---|
| 1,565,558 A | | 12/1925 | Fremon | |
| 1,610,224 A | * | 12/1926 | Dalboni et al. | 70/382 |
| 1,965,889 A | | 7/1934 | Gerald | |
| 2,139,842 A | | 12/1938 | Miller | |
| 2,194,469 A | | 3/1940 | Fremon | |
| 2,232,017 A | | 2/1941 | Wilder | |
| 2,370,862 A | | 3/1945 | Johnstone | |
| 2,391,832 A | | 12/1945 | Johnstone | |
| 2,895,323 A | | 7/1959 | Ernest | |
| 2,977,786 A | | 4/1961 | Kendrick et al. | |
| 3,149,486 A | | 9/1964 | Russell | |
| 3,183,692 A | | 5/1965 | Check | |
| 3,190,093 A | | 6/1965 | Schlage | |
| 3,320,781 A | | 5/1967 | Hill | |
| 3,589,153 A | | 6/1971 | Hill | |
| 3,687,262 A | | 8/1972 | Hill | |
| 3,726,116 A | | 4/1973 | Dimotta | |
| 3,728,880 A | | 4/1973 | Falk | |
| 3,735,612 A | | 5/1973 | Popvici | |
| 3,754,422 A | * | 8/1973 | Stackhouse | 70/492 |
| 3,910,083 A | | 10/1975 | Burlingame | |
| 3,990,282 A | | 11/1976 | Sorum | |
| 3,999,413 A | * | 12/1976 | Raymond et al. | 70/495 |
| 4,015,458 A | | 4/1977 | Mercurio | |
| 4,069,694 A | | 1/1978 | Raymond et al. | |
| 4,094,175 A | | 6/1978 | Pechner | |
| 4,142,391 A | | 3/1979 | Paig | |
| 4,320,639 A | | 3/1982 | Kleefeldt et al. | |
| 4,372,139 A | | 2/1983 | Laake | |
| 4,376,382 A | * | 3/1983 | Raymond et al. | 70/338 |
| 4,377,940 A | | 3/1983 | Hucknall | |
| 4,393,673 A | | 7/1983 | Widen | |
| 4,404,824 A | * | 9/1983 | Hennessy | 70/495 |

(Continued)

*Primary Examiner*—Suzanne Dino Barrett
(74) *Attorney, Agent, or Firm*—Harness, Dickey & Pierce, P.L.C.

(57) ABSTRACT

A re-keyable lock and method. The lock has locked and unlocked positions and includes a housing and a cylinder rotatably supported in the housing. The lock includes a plurality of wafer tumblers resiliently supported in corresponding channels formed in the cylinder. Each wafer tumbler includes a rider element selectively engaged with a base element in first and second engagement positions, wherein the first engagement position corresponds to a first key and the second engagement position corresponds to a second key. The lock also includes a re-keying mechanism such as a re-keying tool which is inserted in a re-keying slot when the lock is in the unlocked position to disengage the rider element from the corresponding base element in the first engagement position and to re-engage the rider element to the base element in the second engagement position.

41 Claims, 7 Drawing Sheets

U.S. PATENT DOCUMENTS 4,412,437 A 11/1983 Smith
4,440,009 A 4/1984 Smith
4,689,978 A 9/1987 Drummond
4,712,399 A * 12/1987 Mattossovich ..... 70/495
4,712,401 A 12/1987 Monahan
4,712,402 A 12/1987 Monahan
4,729,231 A 3/1988 Wu
4,732,023 A 3/1988 Shen
4,741,188 A 5/1988 Smith
4,747,281 A 5/1988 Monahan
4,765,163 A 8/1988 Trull et al.
4,794,772 A 1/1989 Falk et al.
4,836,002 A 6/1989 Monahan
4,850,210 A 7/1989 Adler et al.
4,899,563 A 2/1990 Martin
4,909,053 A 3/1990 Zipf, III et al.
4,912,953 A 4/1990 Wobig
4,920,774 A 5/1990 Martin
4,942,749 A 7/1990 Rabinow
4,966,021 A * 10/1990 Boag ..... 70/383
4,996,856 A 3/1991 Lin et al.
5,010,753 A 4/1991 Boris, Jr.
5,024,071 A 6/1991 Shafirkin
5,038,589 A 8/1991 Martin
5,044,180 A 9/1991 Lebrecht
5,076,081 A 12/1991 Boris, Jr.
5,121,619 A 6/1992 Martin
5,174,136 A 12/1992 Thwing
5,209,088 A 5/1993 Vaks
5,211,044 A 5/1993 Kim
5,233,850 A 8/1993 Schroeder
5,325,690 A 7/1994 Adler et al.
5,428,978 A 7/1995 Tsukano
5,431,034 A 7/1995 Fann et al.
5,540,071 A 7/1996 Reikher
5,640,865 A 6/1997 Widen
5,704,234 A 1/1998 Resch
5,718,136 A 2/1998 Aldieri et al.
5,752,400 A 5/1998 Kim
5,765,417 A * 6/1998 Bolton ..... 70/495
5,781,181 A 7/1998 Yanai et al.
5,884,512 A 3/1999 Wayne
5,921,122 A 7/1999 Lin
5,921,123 A 7/1999 Schwarzkopf et al.
5,970,760 A 10/1999 Shen
5,979,200 A 11/1999 Cliff
6,029,484 A 2/2000 Jetton
6,047,577 A 4/2000 Klimas
6,076,386 A 6/2000 Etchells et al.
6,079,240 A 6/2000 Shvarts
6,119,495 A * 9/2000 Loreti ..... 70/340
6,134,928 A 10/2000 Kang
6,142,717 A 11/2000 Staiger
6,295,850 B1 10/2001 Anderson
6,425,274 B1 7/2002 Laitala et al.
6,516,643 B1 2/2003 Olshausen
6,523,378 B2 2/2003 Kuo
6,532,782 B2 3/2003 Chiu
6,564,601 B2 5/2003 Hyatt Jr.
6,776,017 B2 8/2004 Herdman
2003/0037582 A1 2/2003 Edwards, Jr. et al.
2003/0084692 A1 5/2003 Herdman
2003/0089149 A1 5/2003 Suzuki et al.
2003/0154753 A1 8/2003 Dimig et al.
2004/0069030 A1 * 4/2004 Takadama ..... 70/495

* cited by examiner

RE-KEYABLE LOCK AND METHOD

BACKGROUND OF THE INVENTION

Most common locks are pin-tumbler cylinder locks or wafer-tumbler cylinder locks. Each of these locks contains a cylinder or plug which rotates within a housing or shell. In the pin-tumbler locks, pin holes containing top and bottom pin tumblers extend transversely through both the cylinder and the housing, and may be crossing the shear line, i.e. the boundary between the cylinder and the housing. The pin tumblers slide up and down within the pin holes defining a locked position and an unlocked position. When a pin tumbler crosses the shear line, the pin tumbler interferes with the rotation of the cylinder and the cylinder remains locked. When the correct key is inserted in the lock, the bitting on the key contact the pin tumblers and force them to slide within their pin holes such that no pin crosses the shear line. The cylinder can then rotate within the housing when a torque is applied by the key to unlock the lock.

Wafer-tumbler locks have wafer-shaped tumblers which slide up and down within channels that extend from the cylinder to the housing. The wafer tumblers are spring loaded so that they can extend out of the cylinder and into a locking slot within the housing, thereby preventing rotation of the cylinder relative to the housing in a locked position. The center of each of the wafer tumblers has an opening for receiving a key. The correct key moves the wafer tumblers out of the locking slot, such that torque applied to the cylinder rotates the cylinder within the housing and unlocks of the lock.

To avoid or reduce the costs of changing or re-keying locks in office and apartment buildings, for example, several types of re-keyable locks that do not require disassembly have been developed for pin-tumbler locks, see, for example, U.S. Pat. Nos. 4,412,850 and 5,233,850. Simple and cost-effective re-keyable locks for wafer tumbler systems are still needed.

SUMMARY

One embodiment of the invention provides a re-keyable lock and method. The lock has locked and unlocked positions and may include a housing and a cylinder rotatably supported in the housing and having a plurality of channels. The lock includes a plurality of wafer tumblers resiliently supported in the corresponding channels. Each wafer tumbler has a rider element selectively engaged with a base element in first and second engagement positions, wherein the first engagement position corresponds to a first key and the second engagement position corresponds to a second key. The lock also includes a re-keying slot on a face of the cylinder such that a re-keying tool can be inserted in the slot when the cylinder is in a learn position to disengage each rider element from the corresponding base element in the first engagement position to enable re-engaging the rider element to the base element in the second engagement position. In this manner, the lock may be re-keyed without disassembly of the cylinder assembly.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE INVENTION

Figure 1:
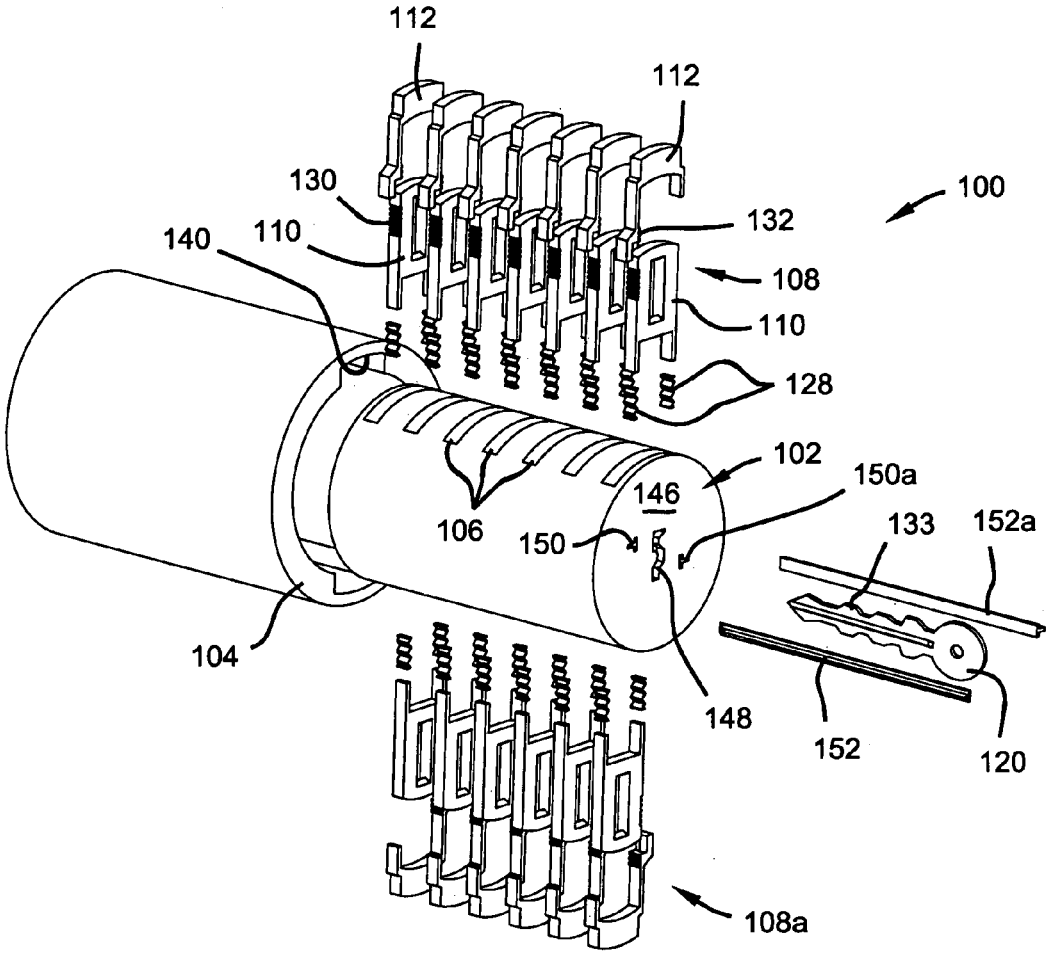
FIG. 1 is an exploded perspective view of an embodiment of a lock according to the present invention.

Referring now to the drawings for the purpose of illustrating the invention without limiting the same, it is to be understood that standard components or features that are within the purview of an artisan of ordinary skill and do not contribute to the understanding of the various embodiments of the invention are omitted from the drawings to enhance clarity and are not described. In addition, it will be appreciated that the characterizations of various components and orientations described herein as being "vertical" or "horizontal", "right" or "left", "side", "top" or "bottom", are relative characterizations only based upon the particular position or orientation of a given component for a particular application.

Figure 4:
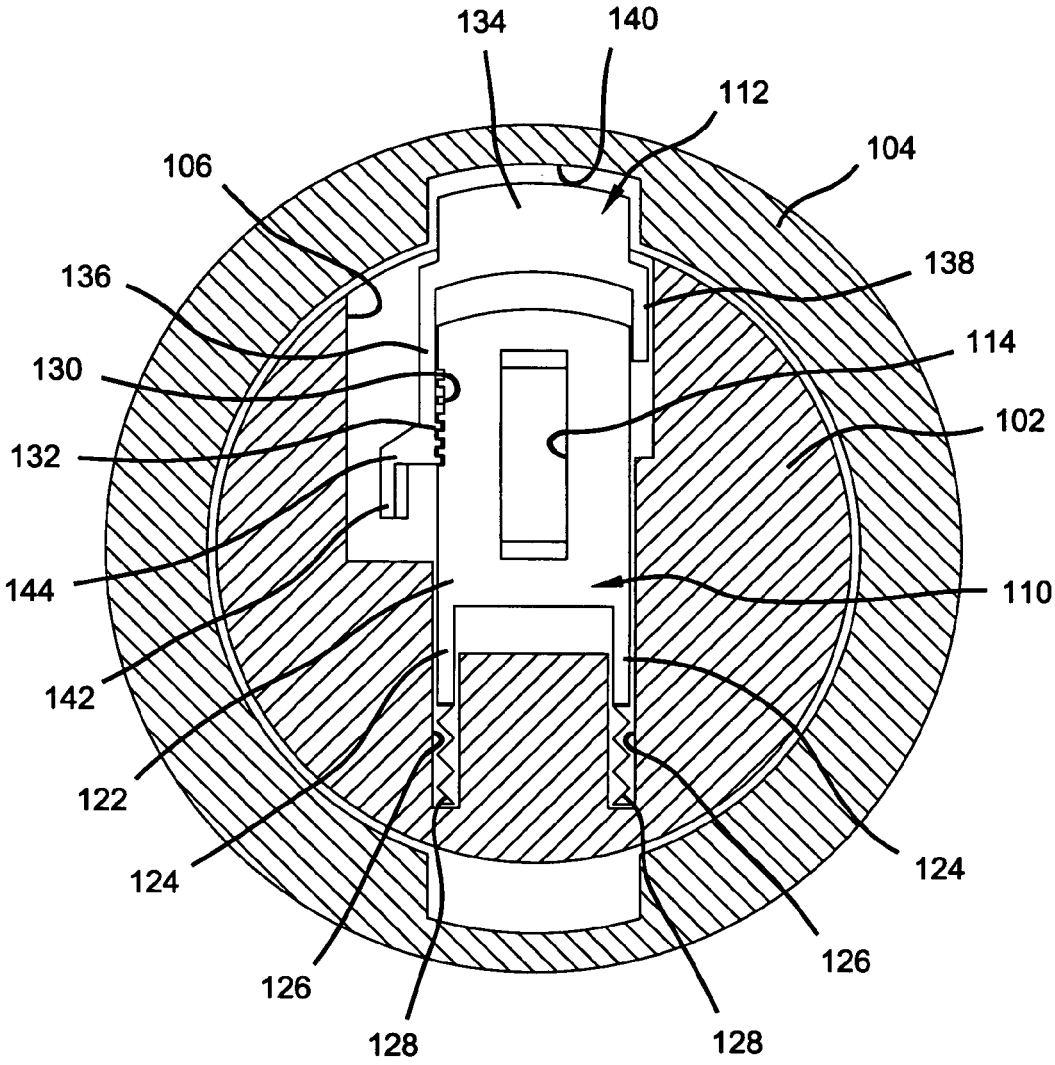
FIG. 4 is a sectional view of the lock showing an embodiment of a first wafer tumbler in a locked and engaged position.

FIG. 1 is an exploded view of an embodiment of a re-keyable lock 100 according to the invention. The lock 100 includes a cylinder 102, which rotates in a housing 104. The cylinder 102 has a plurality of first channels 106 as best see in FIGS. 2 and 4. The first channels 106 are sized to receive a first set of wafer tumblers 108. Each first wafer tumbler 108 includes a base element 110 and a rider element 112. As presently preferred, each base element 110 is a substantially flat plate that has an opening 114 that allows a key 120 to be inserted into the lock 100. In one embodiment, the base element 110 may have a lower portion 122, which may be U-shaped and have two legs 124 as best seen in FIG. 4. The legs 124 may be received in corresponding cavities 126 that extend from the corresponding first channel 106. The base element 110 is resiliently supported in the corresponding first channel 106 by any resilient mechanism, such as, for example, by two springs or coils 128 that are received in the cavities 126. The springs 128 bias the base element 110 toward the housing 104 and away from the cavities 126 to a "locked position", shown in FIG. 4, in which the cylinder 102 cannot turn relative to the housing 104, as is explained below.

Each base element 110 includes a plurality of engagement formations, such as slots or tabs, 130. Each rider element 112 may have an open frame that is supported on a corresponding base element 110. The rider element 112 includes a top portion 134, an engagement arm 136, and a support arm 138. The engagement arm 136 includes one or more engagement formations, such as tabs or slots, 132, that are engagable with one of the engagement formations 130 of the base element 110. The support arm 138 may contact a portion of the base element 110 providing additional stability for the rider element 112. The top portion 134 of the rider element 112 may be biased by the spring-loaded base element 110 into a locking slot 140 in the housing 104, thereby locking the lock 100 and preventing the cylinder 102 from rotating relative to the housing 104. The locking slot 140 is appropriately sized and shaped to receive the upper portion 134 of the rider element 112 in the locked position.

The engagement slots 130 of the base element 110 are spaced at distances that correspond to standard sizes of bitting 133 in the key 120. As is well-known in the art, the sequence of bitting sizes determines the proper key for a lock. Conventionally, each bitting size is designated by an integer number. For a lock with seven wafer tumblers, for example, a sequence of seven digits determines the locking combination of the key. The sequence "1212121", for example, includes three bittings of size 2 and four bittings of size 1. By way of example, when the rider element 112 is provided with one engagement tab 132, and the base element 110 is provided with six engagement slots 130, each wafer tumbler 108 may assume any one of six positions corresponding to six different bitting numbers. When the rider element 112 is provided with two tabs 132 for six engagement slots 130, then each first wafer tumbler 108 may assume any one of five positions corresponding to five different bitting numbers. In the embodiment shown in FIG. 4, the rider element 112 is provided with three engagement tabs 132 for the six engagement slots 130 of the base element 110, and therefore the first wafer tumblers 108 for this embodiment may assume any one of four positions corresponding to four different bitting numbers. In general, the number of different bitting numbers available for each wafer tumbler 108 is determined by the number of available positions in which the engagement tabs 132 can be placed into the engagement slots 130. Assuming that the number of slots N2 is greater than the number of tabs N1, the number of available positions equals N2−N1+1.

It should be appreciated that the shapes of the engagement tabs 132 and the engagement slots 132 do not have to be rectangular, as is shown in the embodiment of FIG. 4. Other shapes, including curves and straight lines may also be used. Furthermore, the placement of the engagement tabs 132 and engagement slots 130 may be interchanged, i.e., the engagement tabs 132 may be placed in the base element 110 and engagement slots 130 may be placed in the rider element 112. A periodic pattern of tabs 132 alternating with slots 130 may also be used in both the engagement arm 136 and the base element 110, as shown in FIG. 4.

As presently preferred, the engagement arm 136 is a flexible element that includes a flange 142 extending from an end 144 that is adjacent to the tabs 132. By exerting a force against the flange 142, the engagement tabs 132 of the rider element 112 may be disengaged from the engagement slots 130 of the base element 110 to allow re-keying the lock 100 as is described below.

Figure 5:
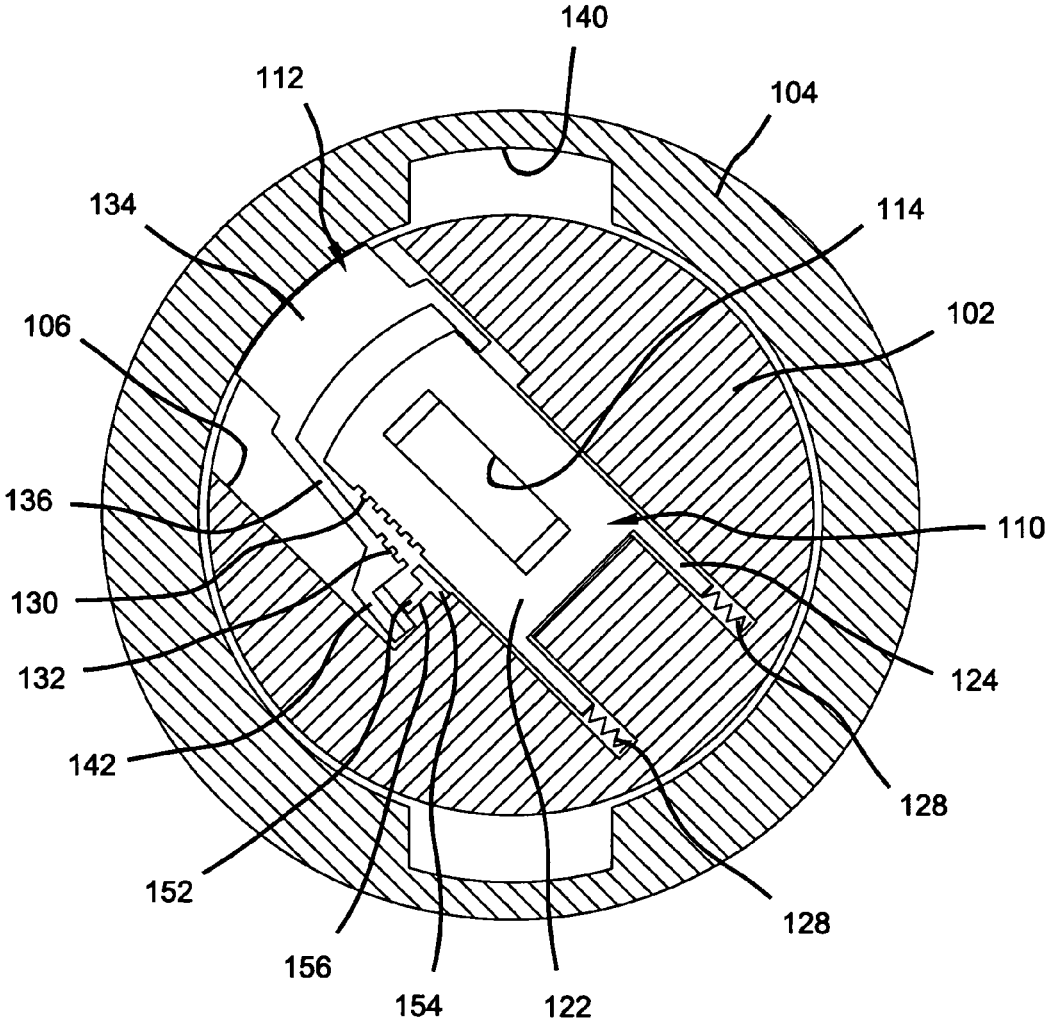
FIG. 5 is a sectional view of the lock showing the first wafer tumbler of FIG. 4 in an unlocked and disengaged position.

The cylinder 102 includes a face 146 having a keyway 148 and a re-keying slot 150. The re-keying slot 150 may be sized to receive a re-keying tool 152. The re-keying tool 152 is a long rod, which, when inserted into the re-keying slot 150, pushes against the flange 146 and the base element 110 causing the engagement arm 136 to deflect, and thereby prying the engagement tabs 132 out of the engagement slots 130. The re-keying slot 150 may be positioned relative to cylinder 102 such that the re-keying tool 152 may engage the flange 142 when the original correct key 120 is inserted in the keyway 148 to rotate the cylinder 102 into an position as shown in FIG. 5. In the unlocked position, each wafer tumbler 108 may be completely received in the corresponding first cylinder channel 106, i.e. all the top portions 136 are disengaged from and are out of the first locking slot 140 of the housing 104, such that there is no interference in the rotation of the cylinder 102 relative to the housing 104.

The re-keying slot 150 may have, for example, a T-shaped cross-section and the tool 152 may also have a T-shaped cross-section. The flange 154 of the tool 152 may push against base element 110, while the web 156 of the tool 152 pushes against the flange 142 of the rider element 112, thereby disengaging the rider element 112 from the base element 110. The re-keying tool 152 is preferably tapered along its length to facilitate disengagement of the rider elements 112 from the base elements 110. While the present invention has been described with reference to a re-keying tool which is separable from the lock 100, one skilled in the art will recognize that similar structure which is integral with the lock could be utilized to provide the described re-keying function.

The lock 100 is re-keyed by the following procedure. Initially, the rider elements 112 are engaged with the base elements 110 in a first engagement position that corresponds to a first key 120, e.g., the original unlocking key 120, as shown in FIG. 4. The first key 120 is inserted in the keyway 148 and the cylinder 102 is rotated to unlock the lock 100 as shown in FIG. 4, thereby placing the lock 100 in a learn mode. In this state, the lock 100 may be re-keyed by insert in the re-keying tool 152 in the re-keying slot 150 such that the engagement arm 136 of the rider element 112 is disengaged from the base element 110. The first key 120 can be removed and a second key inserted in the keyway 148. The tool 152 is then removed, forcing the rider elements 112 to engage the base elements 104 in a second engagement position that is determined by the bitting 133 of the second key, thereby re-keying the lock 100 for the second key.

Figure 2:
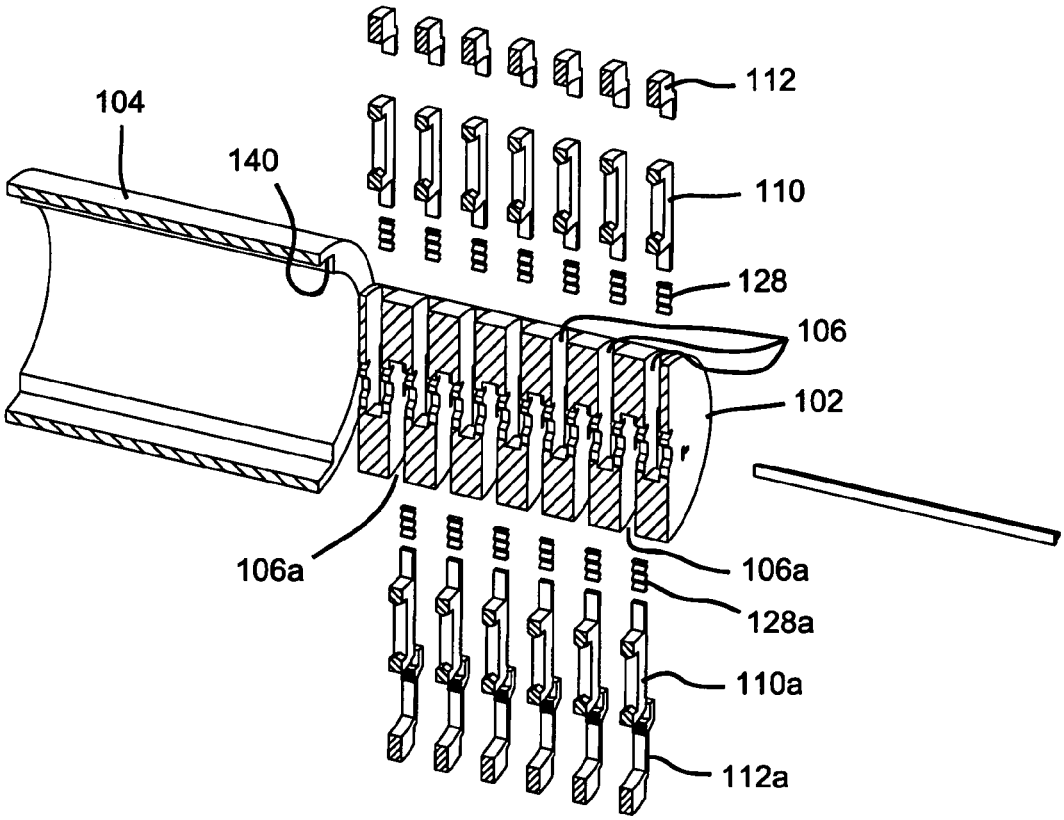
FIG. 2 is a exploded perspective view of a longitudinal section of the lock of FIG. 1.
Figure 3:
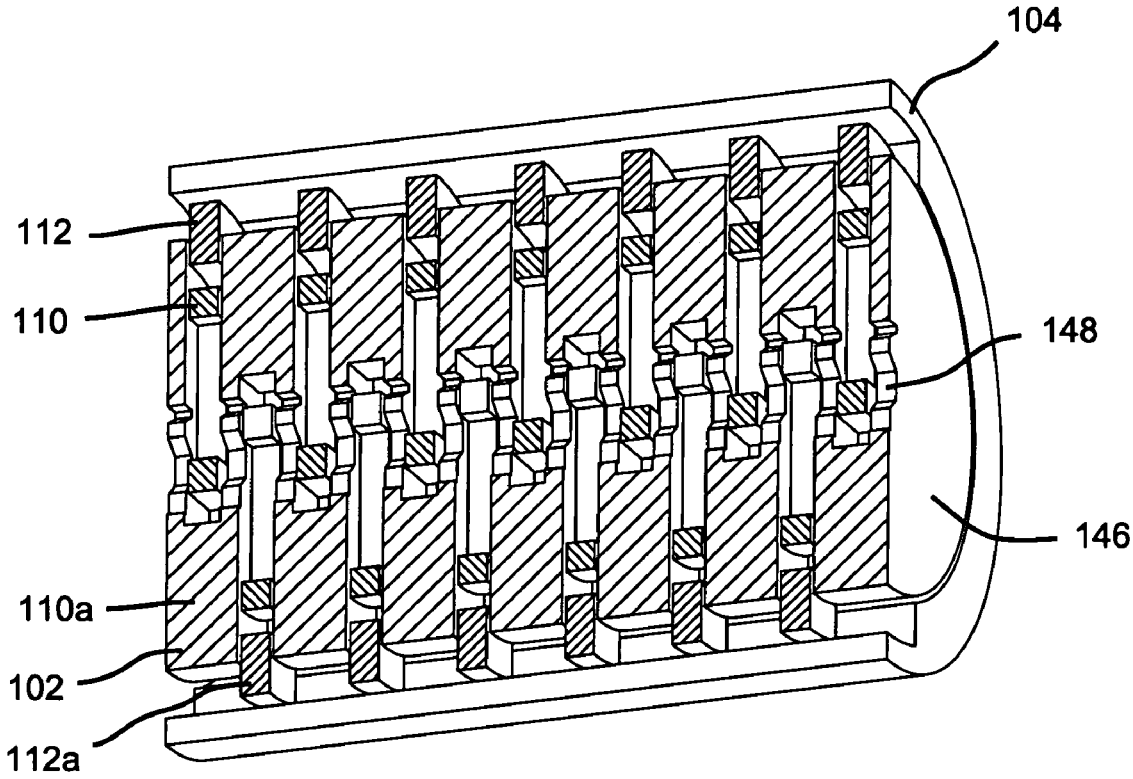
FIG. 3 is an assembled perspective view of a longitudinal section of the lock of FIG. 1.

As illustrated in the Figures, the lock 100 includes a second set of wafer tumblers **108*a* received in corresponding second channels 106*a* in the cylinder 102. The second wafer tumblers 108*a* are similar to first wafer tumblers 108 described above and thus their description will not be repeated. Elements of the second wafer tumblers 108*a* corresponding to similar elements of the first wafer tumblers 108 are indicated by the same reference numbers followed by the letter "a". For example, each second wafer tumbler 108*a* may include a rider element 112*a* and a base element 110*a*, etc. As best seen in FIG. 2, the second channels 106*a* are interlaced with the first channels 106 and the first and second wafer tumblers 108, 108*a* are positioned such that the engagement arms 136, 136*a* are on opposite sides relative to the keyway 148 of the lock 100. As an example, seven first wafer tumblers 108 and six second wafer tumblers 108*a* are shown in the embodiment of FIG. 1**. However, one skilled in the art will recognize that the number and location of water tumblers in a given lock may vary depending on the requirements of the particular application.

Figure 6:
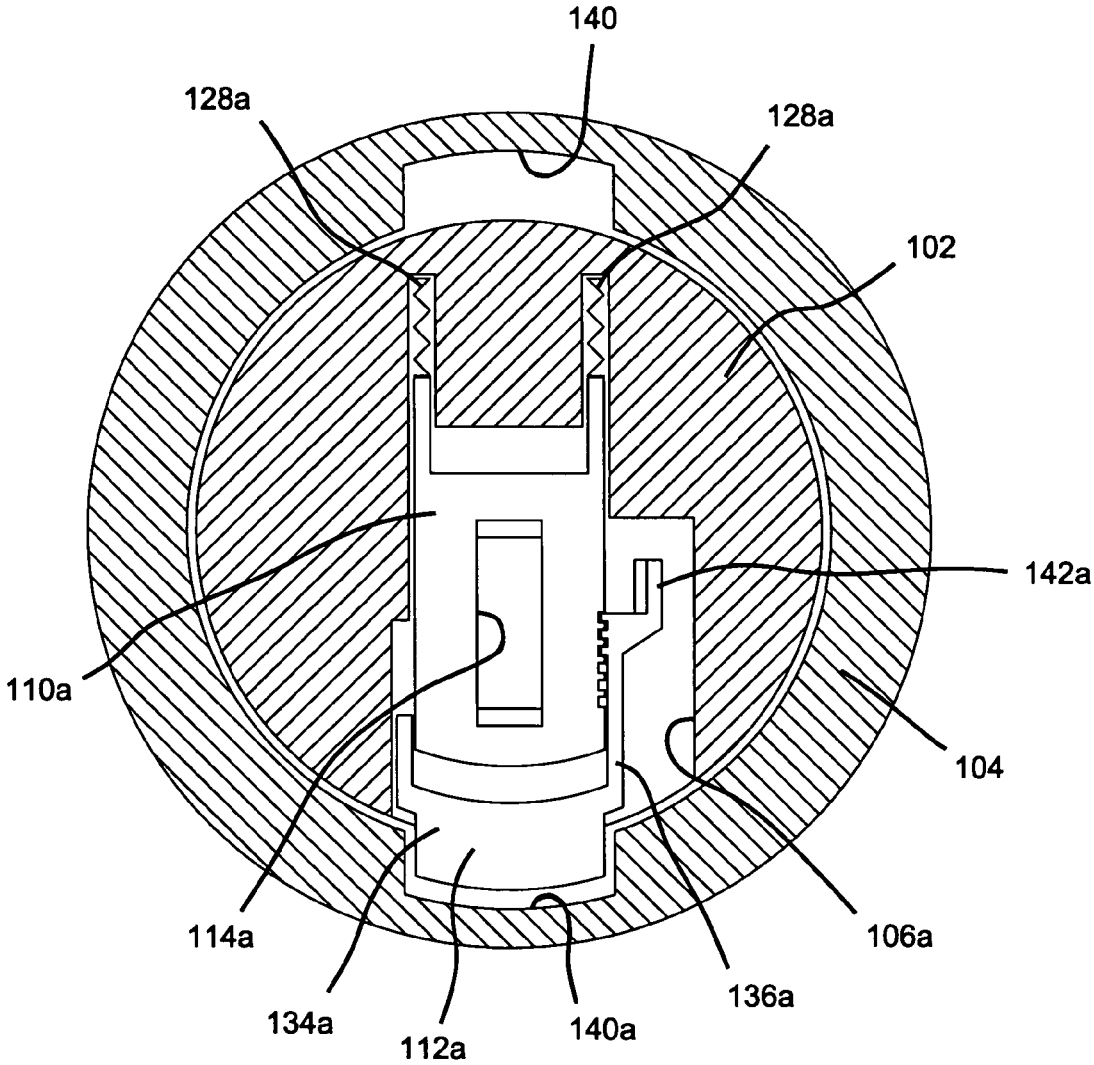
FIG. 6 is a sectional view of the lock showing an embodiment of a second wafer tumbler in a locked and engaged position.
Figure 7:
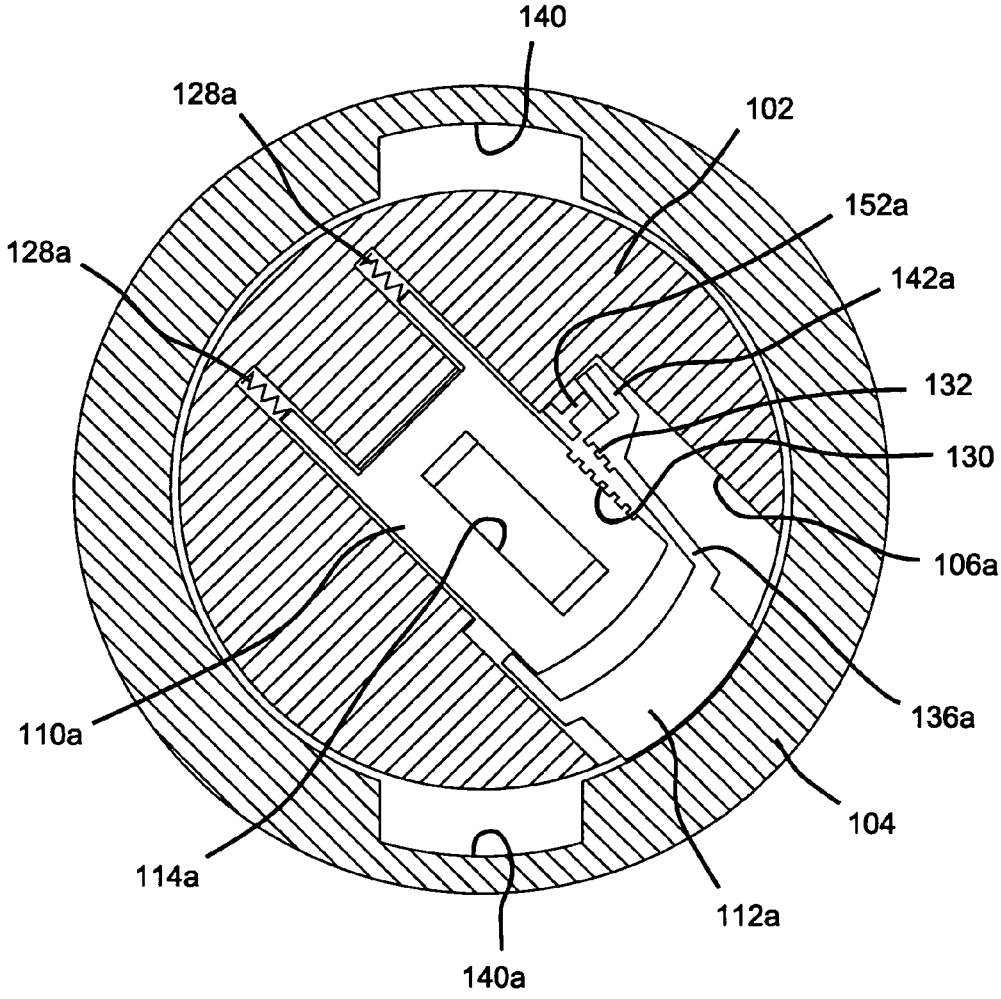
FIG. 7 is a sectional view of the lock showing the second wafer tumbler of FIG. 6 in an unlocked and disengaged position.

The rider elements **112*a* of the second wafer tumblers 108*a* are disengaged from the corresponding base elements 110*a* by inserting a second re-keying tool 152*a* through a second re-keying slot 150*a* on the face 146 of the cylinder 102 in the unlocked position as seen in FIGS. 6 and 7. It will be appreciated that the engagement positions of the second rider elements 112*a* on the second base elements 110*a* are not dictated by, and thus are independent of the engagement positions of the rider elements 112 on the base elements 110. Accordingly, the unlocking keys may have either symmetric or non-symmetric bitting 133**.

In one embodiment, the first and second base elements 110, **110*a* and the first and second rider elements 112, 112*a* may have tapered thickness to facilitate inserting the key 120 in the openings 114,114*a* of the first and second base elements, respectively, and inserting the re-keying tools 152, 152***a* in the corresponding re-keying slots 150, 150*a* as best seen in FIGS. 4–7.

From the above description, it will be appreciated that the invention provides a versatile, cost-effective and convenient re-keyable lock 100. Many combinations of first and second wafer tumblers 108, 108*a* are possible. Many sequences of engagement formations 130, 132 are also available and may be selected for each wafer tumbler 108, 108*a*. Therefore, a great number of new keys may be provided for re-keying the same lock 100 without ever having to disassemble it.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the spirit of the invention. The preceding description, therefore, is not meant to limit the scope of the invention. Rather the scope of the invention is to be determined only by the appended claims and their equivalents.

What is claimed is:

1. A re-keyable lock comprising:

a cylinder rotatably supported in a housing between a locked position and an unlocked position, said cylinder having a longitudinal slot and a transverse channel;

a locking mechanism including a wafer tumbler resiliently supported in said transverse channel and positionable therein between an engaged position wherein said wafer tumbler engages said housing and a disengaged position wherein said wafer tumbler disengages said housing, said wafer tumbler including a base element having an opening formed therethrough which is at least partially aligned with said longitudinal slot, a rider element positionable within said transverse channel relative to said base element and a coupling element integral with the rider element and positionable between a first position wherein said base element is coupled to said rider element and a second position wherein said base element is uncoupled from said rider element, wherein said coupling element comprises a flexible element biased to couple said base element and said rider element, said flexible element being deflectable to uncouple said base element and said rider element; and a re-keying mechanism operable when said cylinder is in said unlocked position to move said coupling element from said first position to said second position for repositioning said rider element relative to said base element such that the lock is re-keyed.

2. The lock of claim 1, wherein said rider element selectively engages a plurality of engagement formations in said base element, each of said plurality of engagement formations corresponding to a bitting size.

3. The lock of claim 2, wherein each of said plurality of engagement formations comprise a tab.

4. The lock of claim 2, wherein each of said plurality of engagement formations comprise a slot.

5. The lock of claim 1, wherein said locking mechanism further comprises a plurality of wafer tumblers, each of said plurality of wafer tumblers resiliently supported in one of a plurality of transverse channels formed in said cylinder.

6. A re-keyable lock comprising:

a cylinder rotatable supported in a housing between a locked position and an unlocked position, said cylinder having a longitudinal slot and a transverse channel;

a locking mechanism including a wafer tumbler resiliently supported in said transverse channel and positionable therein between an engaged position wherein said wafer tumbler engages said housing and a disengaged position wherein said wafer tumbler disengages said housing, said wafer tumbler including a base element having an opening formed therethrough which is at least partially aligned with said longitudinal slot, a rider element positionable within said transverse channel relative to said base element and a coupling element integral with the rider element and positionable between a first position wherein said base element is coupled to said rider element and a second position wherein said base element is uncoupled from said rider element, and a re-keying mechanism operable when said cylinder is in said unlocked position to move said coupling element from said first position to said second position for repositioning said rider element relative to said base element such that the lock is re-keyed, wherein said re-keying mechanism having a re-keying element positionable relative to said wafer tumbler within said cylinder to engage said coupling element, said re-keying element including a re-keying tool insertable into a re-keying slot formed in said cylinder to deflect said flexible element.

7. The lock of claim 6, wherein said re-keying slot is T-shaped.

8. The lock of claim 6, wherein said re-keying tool is tapered.

9. A re-keyable lock comprising:

a cylinder rotatable supported in a housing between a locked position and an unlocked position, said cylinder having a longitudinal slot and a transverse channel;

a locking mechanism including a wafer tumbler resiliently supported in said transverse channel and positionable therein between an engaged position wherein said wafer tumbler engages said housing and a disengaged position wherein said wafer tumbler disengages said housing, said wafer tumbler including a base element having an opening formed therethrough which is at least partially aligned with said longitudinal slot, a rider element positionable within said transverse channel relative to said base element and a coupling element integral with the rider element and positionable between a first position wherein said base element is coupled to said rider element and a second position wherein said base element is uncoupled from said rider element, wherein said base element comprises a first body portion and a pair of legs extending therefrom, said pair of legs being received in a mating portion of said transverse channel;

a pair of springs disposed in said mating portion of said transverse channel and engaging said pair of legs to bias said locking mechanism into said engaged position; and a re-keying mechanism operable when said cylinder is in said unlocked position to move said coupling element from said first position to said second position for repositioning said rider element relative to said base element such that the lock is re-keyed.

10. A re-keyable lock comprising:

a cylinder rotatable supported in a housing between a locked position and an unlocked position, said cylinder having a longitudinal slot and a transverse channel;

a locking mechanism including a wafer tumbler resiliently supported in said transverse channel and positionable therein between an engaged position wherein said wafer tumbler engages said housing and a disengaged position wherein said wafer tumbler disengages said housing, said wafer tumbler including a base element having an opening formed therethrough which is at least partially aligned with said longitudinal slot, a rider element positionable within said transverse channel relative to said base element and a coupling element integral with the rider element and positionable between a first position wherein said base element is coupled to said rider element and a second position wherein said base element is uncoupled from said rider element, wherein said base element includes a first body portion and a pair of legs extending therefrom, said pair of legs being received in a mating portion of said transverse channel, and wherein said rider element includes a pair of arms extending from a second body portion, said pair of arms capturing said first body portion therebetween; and a re-keying mechanism operable when said cylinder is in said unlocked position to move said coupling element from said first position to said second position for repositioning said rider element relative to said base element such that the lock is re-keyed.

11. A re-keyable lock comprising:

a cylinder rotatably supported in a housing between a locked position and an unlocked position, said cylinder having a longitudinal slot, a first set of transverse channels and a second set of transverse channels opposingly interlaced with said first set of transverse channels;

a locking mechanism including:

a first set of wafer tumblers resiliently supported in said first set of transverse channels and positionable therein between an engaged position wherein said first set of wafer tumblers engage said housing and a disengaged position wherein said first set of wafer tumblers disengage said housing; and a set of second wafer tumblers resiliently supported in said second set of transverse channels and positionable therein between an engaged position wherein said second set of wafer tumblers engage said housing and a disengaged position wherein said second set of wafer tumblers disengage said housing;

each wafer tumbler of said first and second sets of wafer tumblers including a base element having an opening formed therethrough which is at least partially aligned with said longitudinal slot, a rider element positionable within said transverse channel relative to said base element and a coupling element integral with the rider element and positionable between a first position wherein said base element is coupled to said rider element and a second position wherein said base element is uncoupled from said rider element, wherein said coupling element includes a flexible element biased to couple said base element and said rider element, said flexible element being deflectable to uncouple said base element and said rider element; and a re-keying mechanism operable when said cylinder is in said unlocked position to move said coupling element from said first position to said second position for repositioning said rider element relative to said base element such that the lock is re-keyed.

12. The lock of claim 11, wherein said rider element selectively engages a plurality of engagement formations in said base element, each of said plurality of engagement formations corresponding to a bitting size.

13. The lock of claim 12, wherein each of said plurality of engagement formations comprise a tab.

14. The lock of claim 12, wherein each of said plurality of engagement formations comprise a slot.

15. A re-keyable lock comprising:

a cylinder rotatable supported in a housing between a locked position and an unlocked position, said cylinder having a longitudinal slot, a first set of transverse channels and a second set of transverse channels opposingly interlaced with said first set of transverse channels;

a locking mechanism including:

a first set of wafer tumblers resiliently supported in said first set of transverse channels and positionable therein between an engaged position wherein said first set of wafer tumblers engage said housing and a disengaged position wherein said first set of wafer tumblers disengage said housing; and a set of second wafer tumblers resiliently supported in said second set of transverse channels and positionable therein between an engaged position wherein said second set of wafer tumblers engage said housing and a disengaged position wherein said second set of wafer tumblers disengage said housing;

each wafer tumbler of said first and second sets of wafer tumblers including a base element having an opening formed therethrough which is at least partially aligned with said longitudinal slot, a rider element positionable within said transverse channel relative to said base element and a coupling element integral with the rider element and positionable between a first position wherein said base element is coupled to said rider element and a second position wherein said base element is uncoupled from said rider element; and a re-keying mechanism operable when said cylinder is in said unlocked position to move said coupling element from said first position to said second position for repositioning said rider element relative to said base element such that the lock is re-keyed, said re-keying mechanism having a re-keying element positionable relative to said wafer tumbler within said cylinder to engage said coupling element, and said re-keying element includes a re-keying tool insertable into a re-keying slot formed in said cylinder to deflect said flexible element.

16. The lock of claim 15, wherein said re-keying slot is T-shaped.

17. The lock of claim 15, wherein said re-keying tool is tapered.

18. A re-keyable lock comprising:

a cylinder rotatably supported in a housing between a locked position and an unlocked position, said cylinder having a longitudinal slot, a first set of transverse channels and a second set of transverse channels opposingly interlaced with said first set of transverse channels;

a locking mechanism including:

a first set of wafer tumblers resiliently supported in said first set of transverse channels and positionable therein between an engaged position wherein said first set of wafer tumblers engage said housing and a disengaged position wherein said first set of wafer tumblers disengage said housing; and a set of second wafer tumblers resiliently supported in said second set of transverse channels and positionable therein between an engaged position wherein said second set of wafer tumblers engage said housing and a disengaged position wherein said second set of wafer tumblers disengage said housing;

each wafer tumbler of said first and second sets of wafer tumblers including a base element having an opening formed therethrough which is at least partially aligned with said longitudinal slot, a rider element positionable within said transverse channel relative to said base element and a coupling element integral with the rider element and positionable between a first position wherein said base element is coupled to said rider element and a second position wherein said base element is uncoupled from said rider element, wherein said base element comprises a first body portion and a pair of legs extending therefrom, said pair of legs being received in a mating portion of said transverse channels;

a pair of springs disposed in said mating portion of said transverse channel and engaging said pair of legs to bias said locking mechanism into said engaged position; and a re-keying mechanism operable when said cylinder is in said unlocked position to move said coupling element from said first position to said second position for repositioning said rider element relative to said base element such that the lock is re-keyed.

19. A re-keyable lock comprising:

a cylinder rotatable supported in a housing between a locked position and an unlocked position, said cylinder having a longitudinal slot, a first set of transverse channels and a second set of transverse channels opposingly interlaced with said first set of transverse channels;

a locking mechanism including:

a first set of wafer tumblers resiliently supported in said first set of transverse channels and positionable therein between an engaged position wherein said first set of wafer tumblers engage said housing and a disengaged position wherein said first set of wafer tumblers disengage said housing; and a set of second wafer tumblers resiliently supported in said second set of transverse channels and positionable therein between an engaged position wherein said second set of wafer tumblers engage said housing and a disengaged position wherein said second set of wafer tumblers disengage said housing;

each wafer tumbler of said first and second sets of wafer tumblers including a base element having an opening formed therethrough which is at least partially aligned with said longitudinal slot, a rider element positionable within said transverse channel relative to said base element and a coupling element integral with the rider element and positionable between a first position wherein said base element is coupled to said rider element and a second position wherein said base element is uncoupled from said rider element, wherein said base element comprises a first body portion and a pair of legs extending therefrom, said pair of legs being received in a mating portion of said transverse channels, wherein said rider element includes a pair of arms extending from a second body portion, said pair of arms capturing said first body portion therebetween; and a re-keying mechanism operable when said cylinder is in said unlocked position to move said coupling element from said first position to said second position for repositioning said rider element relative to said base element such that the lock is re-keyed.

20. A re-keyable lock comprising:

a cylinder rotatably supported in a housing, said cylinder having a longitudinal key slot and a plurality of transverse channels;

a locking mechanism positionable between an unlocked position and a locked position, said locking mechanism including a plurality of wafer tumblers resiliently supported in a corresponding one of said plurality of transverse channels, each of said plurality of wafer tumblers including a rider element selectively engagable with a base element in a first engagement position corresponding to a first key and a second engagement position corresponding to a second key, wherein each of said plurality of wafer tumblers includes a first set of wafer tumblers opposingly interlaced with a second set of wafer tumblers; and a re-keying tool insertable in a re-keying slot centrally offset from the longitudinal key slot, the re-keying tool operable when said locking mechanism is in said unlocked position to disengage each rider element from each base element in said first engagement position and engage each rider element to each base element in said second engagement position, wherein said re-keying tool is associated with said first set of wafer tumblers and a second re-keying tool is insertable in a second re-keying slot and is associated with said second set of wafer tumblers.

21. A re-keyable lock comprising:

a cylinder rotatably supported in a housing between a locked position and an unlocked position, said cylinder having a longitudinal slot and a transverse channel;

a locking mechanism including a wafer tumbler resiliently supported in said transverse channel and positionable therein between an engaged position wherein said wafer tumbler engages said housing and a disengaged position wherein said wafer tumbler disengages said housing, said wafer tumbler including a base element having an opening formed therethrough which is at least partially aligned with said longitudinal slot, a rider element positionable within said transverse channel relative to said base element and a coupling element positionable between a first position wherein said base element is coupled to said rider element and a second position wherein said base element is uncoupled from said rider element, said rider element comprising a pair of arms, said pair of arms capturing a body portion of said base element therebetween; and a re-keying mechanism operable when said cylinder is in said unlocked position to move said coupling element from said first position to said second position for repositioning said rider element relative to said base element such that the lock is re-keyed.

22. The lock of claim 21, wherein said base element comprises a pair of legs extending from said body portion, said pair of legs being received in a mating portion of said transverse channel.

23. The lock of claim 22, further comprising a pair of springs disposed in said mating portion of said transverse channel and engaging said pair of legs to bias said locking mechanism into said engaged position.

24. The re-keyable lock of claim 21 wherein said re-keying mechanism comprises a re-keying element positionable relative to said wafer tumbler within said cylinder to engage said coupling element.

25. A re-keyable lock comprising:

a cylinder rotatably supported in a housing between a locked position and an unlocked position, said cylinder having a longitudinal slot, a first set of transverse channels and a second set of transverse channels opposingly interlaced with said first set of transverse channels;

a locking mechanism including:

a first set of wafer tumblers resiliently supported in said first set of transverse channels and positionable therein between an engaged position wherein said first set of wafer tumblers engage said housing and a disengaged position wherein said first set of wafer tumblers disengage said housing; and a set of second wafer tumblers resiliently supported in said second set of transverse channels and positionable therein between an engaged position wherein said second set of wafer tumblers engage said housing and a disengaged position wherein said second set of wafer tumblers disengage said housing;

each wafer tumbler of said first and second sets of wafer tumblers including a base element having an opening formed therethrough which is at least partially aligned with said longitudinal slot, a rider element positionable within said transverse channel relative to said base element and a coupling element positionable between a first position wherein said base element is coupled to said rider element and a second position wherein said base element is uncoupled from said rider element, said rider element comprising a pair of arms, said pair of arms capturing a body portion of said base element therebetween; and a re-keying mechanism operable when said cylinder is in said unlocked position to move said coupling element from said first position to said second position for repositioning said rider element relative to said base element such that the lock is re-keyed.

26. The lock of claim 25, wherein said base element comprises a pair of legs extending from said body portion, said pair of legs being received in a mating portion of said transverse channel.

27. The lock of claim 26, further comprising a pair of springs disposed in said mating portion of said transverse channel and engaging said pair of legs to bias said locking mechanism into said engaged position.

28. The re-keyable lock of claim 25 wherein said re-keying mechanism comprises a re-keying element positionable relative to said wafer tumbler within said cylinder to engage said coupling element.

29. A re-keyable lock comprising:

a cylinder rotatable supported in a housing, said cylinder having a longitudinal key slot and a transverse channel;

a locking mechanism positionable between an unlocked position and a locked position, said locking mechanism including a wafer tumbler resiliently supported in said transverse channel, said wafer tumbler including a rider element selectively engagable with a base element in a first engagement position corresponding to a first key and a second engagement position corresponding to a second key; and a re-keying slot centrally offset from the longitudinal key slot and operable for accessing said rider element when said locking mechanism is in said unlocked position to disengage said rider element from said base element in said first engagement position and engage said rider element to said base element in said second engagement position, wherein said rider, wherein said coupling element includes a flexible element biased to couple said base element and said rider element, said flexible element being deflectable to uncouple said base element and said rider element.

30. The lock of claim 29, wherein said locking mechanism further comprises a plurality of wafer tumblers, each of said plurality of wafer tumblers resiliently supported in one of a plurality of transverse channels formed in said cylinder.

31. The lock of claim 30, wherein each of said plurality of wafer tumblers comprises a first set of wafer tumblers opposingly interlaced with a second set of wafer tumblers.

32. The lock of claim 29, wherein said rider element selectively engages a plurality of engagement formations in said base element, each of said plurality of engagement formations corresponding to a bitting size.

33. The lock of claim 32, wherein each of said plurality of engagement formations comprise a tab.

34. The lock of claim 32, wherein each of said plurality of engagement formations comprise a slot.

35. The lock of claim 29, further comprising a re-keying tool insertable into said re-keying slot.

36. A re-keyable lock comprising:

a cylinder rotatably supported in a housing, said cylinder having a longitudinal key slot and a transverse channel;

a locking mechanism positionable between an unlocked position and a locked position, said locking mechanism including a wafer tumbler resiliently supported in said transverse channel, said wafer tumbler including a rider element selectively engagable with a base element in a first engagement position corresponding to a first key and a second engagement position corresponding to a second key; and a re-keying slot centrally offset from the longitudinal key slot and operable for accessing said rider element when said locking mechanism is in said unlocked position to disengage said rider element from said base element in said first engagement position and engage said rider element to said base element in said second engagement position, wherein said re-keying slot is T-shaped.

37. A re-keyable lock comprising:

a cylinder rotatably supported in a housing, said cylinder having a longitudinal key slot and a transverse channel;

a locking mechanism positionable between an unlocked position and a locked position, said locking mechanism including a wafer tumbler resiliently supported in said transverse channel, said wafer tumbler including a rider element selectively engagable with a base element in a first engagement position corresponding to a first key and a second engagement position corresponding to a second key, wherein said base element comprises a first body portion and a pair of legs extending therefrom, said pair of legs being received in a mating portion of said transverse channel; a pair of springs disposed in said mating portion of said transverse channel and engaging said pair of legs to bias said locking mechanism into said engaged position; and a re-keying slot centrally offset from the longitudinal key slot and operable for accessing said rider element when said locking mechanism is in said unlocked position to disengage said rider element from said base element in said first engagement position and engage said rider element to said base element in said second engagement position.

38. The lock of claim 37, wherein said rider element comprises a pair of arms extending from a second body portion, said pair of arms capturing said first body portion therebetween.

39. A method for in-situ re-keying of a lock, the method comprising:

inserting a first key into a key hole of a lock cylinder;

rotating said lock cylinder relative to a housing with said first key to put the lock into a learn position;

accessing a re-keying slot of said lock cylinder, said re-keying slot being centrally offset from said key hole;

uncoupling a first element of a wafer tumbler from a second element of said wafer tumbler;

replacing said first key with a second key such that said first element is re-positioned relative to said second element;

biasing a flexible element interposed between said first element and said second element to couple said first element to said second element of said wafer tumbler;

rotating said lock cylinder to a locked position with said second key; and removing said second key.

40. The method of claim 39, wherein uncoupling includes deflecting said flexible element to uncouple said first element from said second element.

41. The method of claim 39, wherein accessing includes inserting a re-keying tool into the re-keying slot.

* * * * *

UNITED STATES PATENT AND TRADEMARK OFFICE

CERTIFICATE OF CORRECTION

PATENT NO. : 6,973,813 B2
APPLICATION NO. : 10/729555
DATED : December 13, 2005
INVENTOR(S) : Edward Erdely It is certified that error appears in the above-identified patent and that said Letters Patent is hereby corrected as shown below:

Title Page,
Item [56] References Cited, U.S. PATENT DOCUMENTS, Patent No. 3,735,612, "Popvici" should read -- Popovici --.

Item [56] References Cited, U.S. PATENT DOCUMENTS, page 2,
"5,781,181 A 7/1998 Yanai et al" should be
-- 5,791,181, A 8/1998 Sperber et al. --.

Item [56] References Cited, FOREIGN PATENT DOCUMENTS, insert the following:
-- FOREIGN PATENT DOCUMENTS

| | | |
|---|---|---|
| EP | 0157967 | 10/1985 |
| EP | 0210037 | 1/1987 |
| EP | 0872615 | 10/1998 |
| WO | WO9314290 | 7/1993 |
| WO | WO9736072 | 10/1997 --. |

Column 5,
Line 65, "rotatable" should be -- rotatably --.

Column 6,
Lines 32 and 63, "rotatable" should be -- rotatably --.

Column 8,
Line 6, "rotatable" should be -- rotatably --.

Column 9,
Line 28, "rotatable" should be -- rotatably --.

Column 11,
Line 52, "rotatable" should be -- rotatably --.

UNITED STATES PATENT AND TRADEMARK OFFICE

CERTIFICATE OF CORRECTION

PATENT NO. : 6,973,813 B2
APPLICATION NO. : 10/729555
DATED : December 13, 2005
INVENTOR(S) : Edward Erdely It is certified that error appears in the above-identified patent and that said Letters Patent is hereby corrected as shown below:

Column 12,
Line 2, after "rider" insert -- element includes a coupling element, --.

Signed and Sealed this

Ninth Day of January, 2007

JON W. DUDAS
*Director of the United States Patent and Trademark Office*